United States Patent [19]

Pidgeon et al.

[11] 4,138,010

[45] Feb. 6, 1979

[54] CONTROLLED BUNKER SYSTEMS

[75] Inventors: Brian G. Pidgeon; Joseph Dowell, both of Burton-on-Trent, England

[73] Assignee: Coal Industry (Patents) Limited, London, England

[21] Appl. No.: 801,377

[22] Filed: May 27, 1977

[30] Foreign Application Priority Data

Jun. 18, 1976 [GB] United Kingdom ..... 25346/76

[51] Int. Cl.[2] ..... B65G 47/19

[52] U.S. Cl. ..... 198/573; 198/856

[58] Field of Search ..... 214/17 CA; 198/502, 198/572, 573, 577, 856

[56] References Cited

U.S. PATENT DOCUMENTS 3,512,662 5/1970 Strydom ..... 198/572 X

FOREIGN PATENT DOCUMENTS 791497 8/1968 Canada ..... 198/502

*Primary Examiner*—Robert G. Sheridan

*Attorney, Agent, or Firm*—Stevens, Davis, Miller & Mosher

[57] ABSTRACT

An automatically controlled bunker system includes a plurality of sensor means for sensing various operational conditions within the bunker system and for deriving signals indicative of the sensed operational conditions. The derived signals are fed to control means which control operation of the bunker system in accordance with the sensed operational conditions.

10 Claims, 9 Drawing Figures

CONTROLLED BUNKER SYSTEMS

This invention relates to the control of bunker systems in which particulate material is capable of being fed into the bunker systems at times when there is an excess of particulate material and of being discharged from the bunker systems at times when there is a shortage of particulate material.

Accordingly, the present invention provides a control system for a bunker system comprising a particulate material storage bunker having discharge means for particulate material feed means for feeding particulate material into the bunker, a hopper arranged adjacent to the discharge means for receiving particulate material from the feed means and/or from the discharge means and conveyor means for conveying material from the hopper, the control system comprising first sensor means for sensing the presence or absence of particulate material at a preselected low level in the hopper, said first sensor means deriving a signal indicative of the presence or absence of particulate material at said low level, second sensor means for sensing when the particulate material has reached a preselected high level in the hopper, said second sensor means deriving a signal indicative of the presence or absence of particulate material at said high level, and control means for controlling the operational mode of the bunker system in response to the signals derived by the sensor means and indicative of the sensed conditions.

Advantageously, the control system comprises third sensor means for sensing the presence or absence of particulate material in the bunker, said third sensor means deriving a signal indicative of the presence or absence of particulate material in the bunker.

Preferably, the control system comprises fourth sensor means for sensing the presence of particulate material lodged in the hopper, said fourth sensor means deriving a signal indicative of the presence or absence of particulate material lodged in the hopper.

Preferably, the control system comprises fifth sensor means for sensing the amount of particulate material conveyed from the hopper, said fifth sensor means deriving a signal indicative of the amount of particulate material conveyed from the hopper.

Conveniently, a component of the bunker is hauled to and fro as particulate material is fed into or discharged from the bunker and in which case the control system comprises sixth sensor means for sensing the operational position of said component of the bunker, said sixth sensor means deriving a signal indicative of the sensed operational position of said component.

Advantageously, the control system comprises seventh sensor means for sensing when the bunker is full, said seventh sensor means deriving a signal indicative of when the bunker is full.

Accordingly, the present invention also provides a controlled bunker system comprising a particulate material storage bunker having discharge means for particulate material, feed means for feeding particulate material into the bunker, a hopper arranged adjacent to the discharge means for receiving particulate material from the feed means and/or from the discharge means, conveyor means for conveying material from the hopper, first sensor means for sensing the presence or absence of particulate material at a preselected low level in the hopper, said first sensor means deriving a signal indicative of the presence or absence of particulate material at said low level, second sensor means for sensing when the particulate material has reached a preselected high level in the hopper, said second sensor means deriving a signal indicative of the presence or absence of particulate material at said high level, and control means for controlling the operational mode of the bunker system in response to signals derived by the sensor means and indicative of the sensed conditions.

Advantageously, third sensor means are provided for sensing the presence or absence of particulate material in the bunker, said third sensor means deriving a signal indicative of the presence or absence of particulate material in the bunker.

Preferably, fourth sensor means are provided for sensing the presence of particulate material lodged in the hopper, said fourth sensor means deriving a signal indicative of the presence of particulate material lodged in the hopper.

Preferably, fifth sensor means are provided for sensing the amount of particulate material conveyed from the hopper, said fifth sensor means deriving a signal indicative of the amount of particulate material conveyed from the hopper.

Conveniently, a component of the bunker is hauled to and fro as particulate material is fed into or discharged from the bunker and in which case sixth sensor means are provided to sense the operational position of said component of the bunker.

Advantageously, seventh sensor means are provided for sensing when the bunker is full, said seventh sensor means deriving a signal indicative of the bunker being full.

By way of example only, one embodiment of the present invention will be described with reference to the accompanying drawings in which FIG. 1 is a diagram showing the controlled bunker system;

Figure 3:
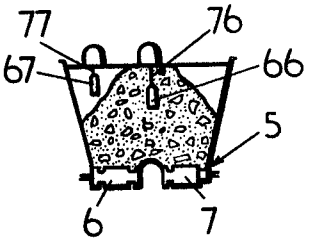
FIG. 3 is a diagrammatic cross-sectional view of the detail in FIG. 2.
Figure 5:
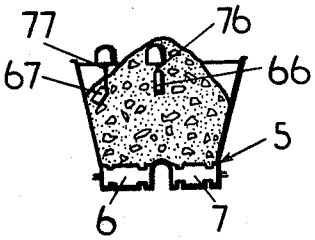
Figure 2:
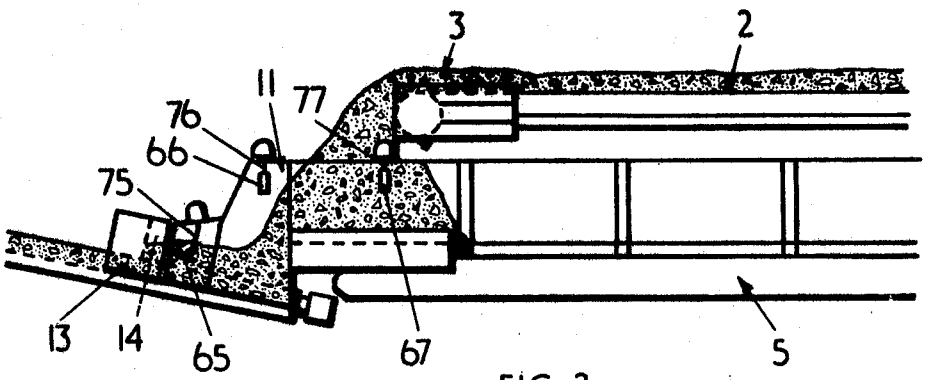
FIG. 2 is a diagrammatic side view of a detail of FIG. 1, the detail being in one operational position.

FIGS. 4, and 5, 6 and 7, and 8 and 9 are similar to FIGS. 2 and 3 but show the detail in different operational positions.

Figure 1:
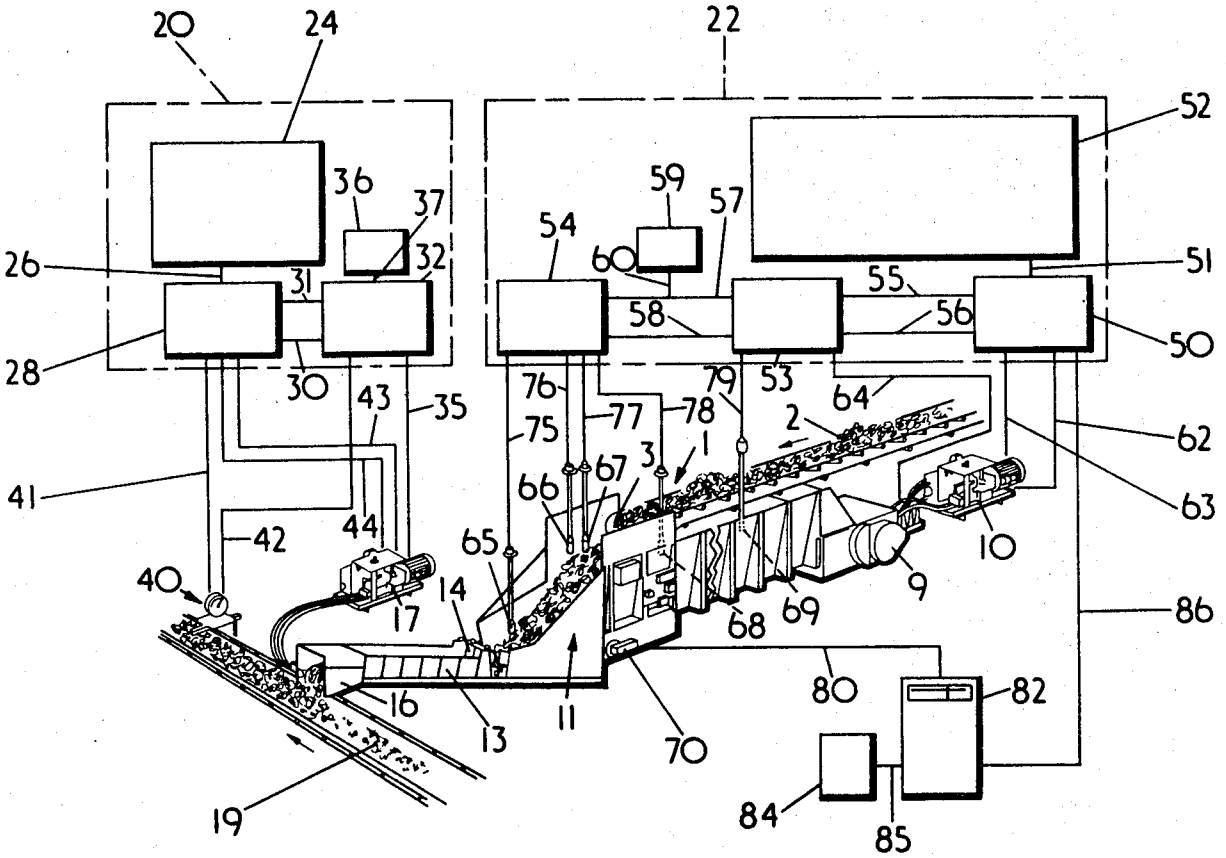

Referring to FIG. 1, the controlled bunker system comprises an underground mine horizontal bunker 1 for storing particulate material, for example, coal which is won by a machine (not shown) and fed along a conveyor 2 to feed means 3 constituted by the conveyor 2 discharge for feeding the material into the bunker 1. In use, the amount of material stored in the bunker varies as particulate material is fed into the bunker at times when an excess of material is being produced by the machine or is discharged from the bunker at times when little or no material is being produced. The operational mode of the bunker is determined by a conveyor component 5 (see FIGS. 2 to 9) situated along the bottom of the bunker and constituted by two parallel scraper chain conveyors 6 and 7 which are hauled to and fro to feed particulate material into, or discharge material from, the bunker. The conveyors 6 and 7 are driven to and fro by a hydraulic drive 9 which is situated at the end of the bunker remote from the feed means 3 and which is supplied with pressure fluid by a driven pump unit 10.

Particulate material is discharged from the bunker 1 into a hopper 11 situated adjacent to the feed means 3 such that the feed means is capable of feeding particulate material directly into the hopper or into the bunker when the hopper is full. The hopper constitutes a storage chute for feeding particulate material onto a conveyor 13, an overhead door 14 (see particularly FIGS. 2 and 4) being provided to determine the maximum height of particulate material leaving the hopper. The conveyor 13 has an adjustable hydraulic drive 16 so that the rate at which particulate material leaving the hopper can be varied, the adjustable drive 16 being supplied with pressure fluid from a variable output driven pump unit 17. The conveyor 13, overhead door 14 and hydraulic drive 16 constitute metering means.

The conveyor 13 feeds the particulate material onto a main conveyor 19 which is supplied with particulate material from sources (not shown) other than the controlled bunker system 1, 2 11, 13. The other sources may include similar bunker systems to that shown in FIG. 1.

The controlled bunker system is provided with a control system including control means 20 for controlling the outfeed from the bunker system and control means 22 for controlling the operational mode of the bunker system. Each of the control means 20, 22 receives signals from sensor means arranged to sense various operational conditions and to derive signals indicative of the sensed operational conditions.

The control means 20 comprises an indicator and/or monitor unit 24 which may be located on the mine surface and which is fed with information via line 26 from a main control unit 28 situated closer to the bunker system. The main control unit 28 is in bi-directional communication via lines 30 and 31 with a slave control unit 32 which controls the pump unit 17 supplying the adjustable hydraulic drive 16 for the conveyor 13 to vary the rate of discharge of particulate material from the bunker system onto the main conveyor 19. The slave control unit receives its instructions via line 30 and informs the main control unit 28 that the instructions have been carried out via line 31. The slave control unit passes its instructions to the pump unit 17 via line 35.

A power supply unit 36 supplies an intrinsically safe power supply to the slave control unit via line 37.

A weighing device 40 senses the flow rate of particulate material on the main conveyor 19 and a signal indicative of the sensed flow rate is fed along line 41 to the main control unit 28 which compares the sensed actual flow rate against a desired or preselected flow rate and if necessary adjusts the feed rate from the bunker system by feeding a signal via line 30 to the slave control unit 32 which in turn feeds a signal via line 35 to suitably adjust the speed of the conveyor 13 and vary the rate of delivery from the bunker system onto the main conveyor 19. The weighing device 40 feeds a signal along line 42 to the slave control unit 32 which thereby checks that the required adjustment has been made. Thus, a closed loop control circuit is established.

Two lines 43 and 44 interconnect the pump unit 17 with the main control unit 28, the line 43 feeding stop/-start signals from the main control unit to control the running of the pump unit and the line 44 passing signals indicative of the pressure, temperature and level of the pressure fluid at the pump unit to the main control unit.

Thus the control means 20 controls the delivery operation of the bunker systems and also senses that the pump unit 17 and discharge conveyor 13 are operating correctly.

The control means 22 for controlling the operational mode of the bunker system comprises a main control unit 50 sited near to the bunker system and in communication via line 51 with an indicator and/or monitor unit 52 which may be mounted on the mine surface. The main control unit 50 is in bi-direction communication with a bunker control unit 53 and with a probe control unit 54 via lines 55, 56 and 57, 58. Control signals are fed along the lines 56 and 58 from the main control unit 50 and signals indicative of sensed conditions (to be discussed later in this specification) are fed along the lines 55 and 57 to the main control unit 50. An intrinsically safe power supply is supplied to the control circuit from a power supply unit 59 via line 60.

Stop/start and direction control signals are fed from the main control unit 50 via line 62 to control the running of the pump unit 10 and thereby of the conveyor drive 9. A further line 63 feeds signals indicative of the pressure, temperature and level of the pressure fluid in the pump unit 10 to the main control unit 50. Also, the conveyor drive 9 is controlled from the bunker control unit 53 by signals fed along line 64.

A plurality of sensor means in the form of probes 65, 66, 67, 68, 69 and a transducer 70 are provided to sense various operational conditions associated with the bunker system and to derive signals indicative of the sensed conditions, the derived signals being fed to the probe control unit 54 or to the bunker control unit 53 via associated lines 75, 76, 77, 78, 79 and 80, respectively.

The function of the sensor means will now be discussed in turn.

Probe 65 is arranged to sense the presence or absence of particulate material at a preselected low level in the hopper. The sensing element of this probe is normally buried in the particulate material and in this operational condition the probe feeds a signal to the probe control unit 54 which permits the bunker conveyor component 5 either to be stationary (as indicated in FIGS. 2 and 3) or alternatively to convey particulate material into the bunker (as indicated by arrow X in FIG. 4). The adopted operational mode of the bunker system when the probe 65 senses material is present at the low level is dependent upon the operational condition sensed by the probe 67. If the probe 65 senses that the level of particulate material in the hopper 11 is below the preselected low level then a signal is fed along line 75 to the probe control unit which permits the bunker conveyor component either to feed particulate material into the hopper (as indicated by arrow Y in FIG. 6) or alternatively to feed material into the bunker (as indicated by arrow Z in FIG. 8). The adopted operational mode of the bunker system when the probe 65 senses the level of material in the hopper is low is dependent upon the operational condition sensed by probe 66.

Figure 9:
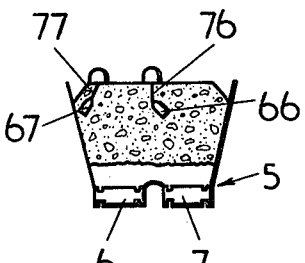
Figure 6:
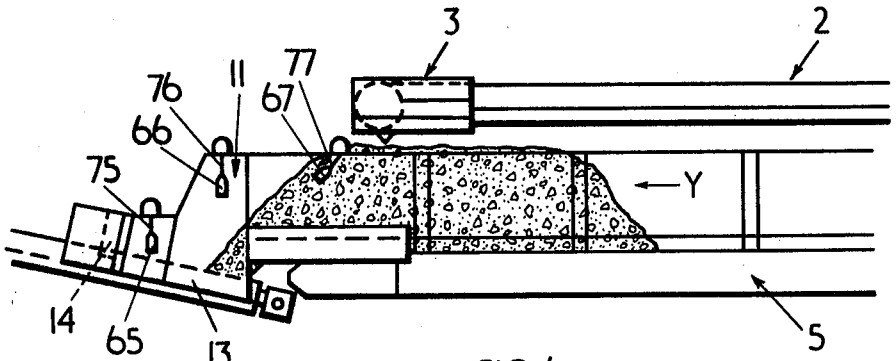
Figure 8:
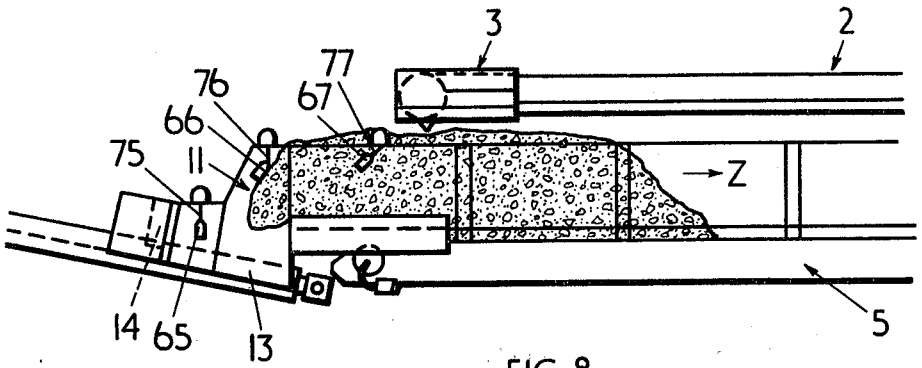

Probe 66 is provided as a safeguard and senses when particulate material has become lodged in the upper region of the hopper 11 instead of flowing down towards the conveyor 13. This probe 66 is normally away from the material in the hopper and when not sensing the presence of particulate material permits normal operational modes of the bunker system to exist. However, if the probe 66 does sense the presence of particulate material then the associated signal fed via lines 76, 58 and 56 and the probe control unit 54 to the main control unit 50 prevents the bunker conveyor component 5 from feeding material out of the bunker. Thus, if particulate material is lodged in the hopper (a condition as indicated in FIGS. 8 and 9) the probe 66 overrides the instruction given by probe 65 which senses the absence of material at the low level, to prevent the bunker discharging material into the hopper. It is clear from FIG. 8 that if the bunker started to discharge more material the hopper would tend to be damaged and/or spillage of material would occur in the vicinity of the hopper. Probe 66 prevents such an overload condition arising.

The control means would realise that even though the probes 66, 67 and 68 were indicating the presence of particulate material in the bunker no material was being conveyed by the conveyor 13. Consequently, it would realise that the bunker system was not operating correctly and a warning signal would inform an operator who could then rectify the condition by dislodging the material in the hopper and rapidly returning the probe 66 to its normal working condition remote from the flow of material. The bunker system would then work normally under the action of the control means.

Figure 4:
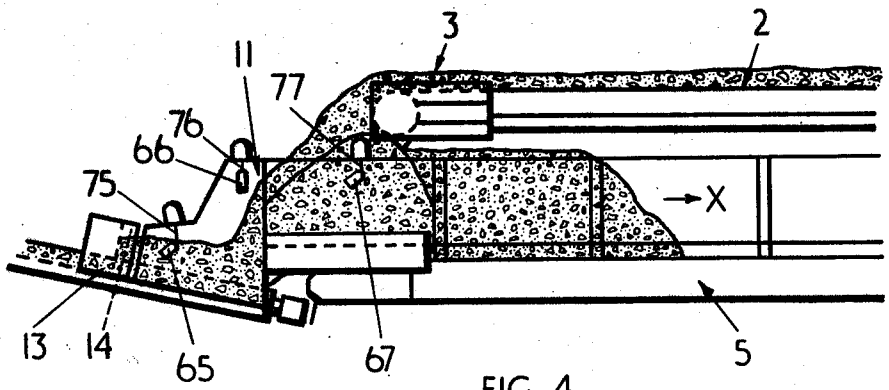
Figure 7:
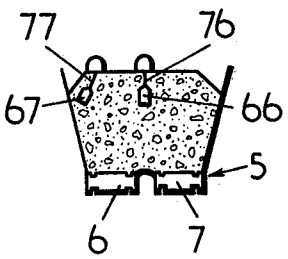

The probe 67 is located adjacent to the discharge from the feed means 3 and from the bunker. It is situated towards one side of the bunker and senses when the level of particulate material in the discharge portion of the bunker has reached a preselected high level. Upon sensing the presence of material at the preselected high level the probe 67 feeds a signal along line 77 to the probe control unit 54 and then to the main control unit 50 to permit the bunker conveyor component to feed material into the bunker (as indicated in FIG. 4). However, this instruction given by probe 67 can be overridden by instructions from other probes including probes 65 and 69. In the normal running condition probe 67 is remote from the material flow (as indicated in FIG. 2) and is arranged to sense when the hopper is full and then to instruct the control means to feed material into the bunker.

Probes 68 and 69 sense the presence or absence of particulate material in the adjacent portions of the bunker and derive signals indicating when the bunker is empty and full, respectively. These two probes function in combination with the transducer 70 which senses longitudinal positions of the bunker conveyor component 5 and derives a signal indicative of the amount of material in the bunker. The transducer 70 is described in more detail in our co-pending U.K. application no. 24290/76.

The transducer 70 feeds the derived signal along line 80 to an indicator unit 82 which gives a visual display of the amount of material in the bunker. The indicator unit 82 is supplied with an intrinsically safe power supply from a power supply unit 84 via line 85. A signal indicative of the amount of material in the bunker is fed from the indicator unit 82 via line 86 to the main control unit 50 which thereby controls the operational condition of the bunker to feed material in or out of the bunker or to keep the bunker conveyor component stationary. When the probe 69 senses the presence of material in the adjacent portion of the bunker it derives a signal indicating that the bunker is full and instructs the main control unit 50 via the bunker control unit 53 not to permit any more material to be fed into the bunker until some discharge has first taken place. When the probe 68 senses the absence of material adjacent to the discharge from the bunker it derives a signal indicating that the bunker is empty and feeds the derived signal instructing the main control unit 50 via the bunker control unit 53 to stop the bunker conveyor component 5 from moving in the outfeed or discharge direction.

From the above description it will be seen that a controlled bunker system is provided which enables the storage and discharge of coal won from a longwall face to be handled automatically.

In a modified arrangement of the system the variable speed conveyor 13 is replaced by a vibratory conveyor. In further modifications the conveyor has a constant speed and the rate of discharge is varied by adjusting the height of the overhead door 14 to vary the thickness of the bed of material on the conveyor.

In other modified arrangements of the system the bunker comprises a fixed conveyor and movable container means, the component which is hauled to and fro being constituted by the container means.

What is claimed is:

1. A control system for a bunker system having a particulate material storage bunker having discharge means for particulate material, feed means for feeding particulate material into said bunker, a hopper arranged adjacent to said discharge means for receiving particulate material from said feed means and from said discharge means, conveyor means, metering means and first sensor means, said conveyor, metering and first sensor means cooperating to convey material from said hopper at a preselected rate, said control system comprising first and second control means, said first control means being associated with said metering means and first sensor means to control the rate of outfeed from the bunker system and said second control means controlling the operational mode of the bunker system, said second control means being associated with second sensor means for sensing the presence or absence of particulate material at a preselected low level in the hopper, said second sensor means deriving a signal indicative of the presence or absence of particulate material at said low level, and third sensor means for sensing when the particulate material has reached a preselected high level in the hopper, said third sensor means deriving a signal indicative of the presence or absence of particulate material at said high level, said second control means controlling the operational mode of the bunker system in response to the signals derived by said second and third sensor means and indicative of the sensed conditions.

2. A control system as claimed in claim 1 wherein said second control means is associated with fourth sensor means for sensing the presence or absence of particulate material in the bunker, said fourth sensor means deriving a signal indicative of the presence or absence of particulate material in the bunker.

3. A control system as claimed in claim 2 wherein said second control means is associated with fifth sensor means for sensing the presence of particulate material lodged in the hopper, said fifth sensor means deriving a signal indicative of the presence or absence of particulate material lodged in the hopper.

4. A control system as claimed in claim 3 wherein said second control means comprises sixth sensor means for sensing the operational position of a component of the bunker which is hauled to and fro as particulate material is fed into or discharged from the bunker, said sixth sensor means deriving a signal indicative of the sensed operational position of said component.

5. A control system as claimed in claim 4 wherein said second control means comprises seventh sensor means for sensing when the bunker is full, said seventh sensor means deriving a signal indicative of when the bunker is full.

6. A bunker system comprising a particulate material storage bunker having discharge means for particulate material, feeds means for feeding particulate material into said bunker, a hopper arranged adjacent to said discharge means for receiving particulate material from said feed means and from said discharge means, conveyor means, metering means and first sensor means, said conveyor, metering and first sensor means cooperating to convey material from the hopper at a preselected rate, and a control system comprising first and second control means, said first control means being associated with said metering means and first sensor means to control the rate of outfeed from the bunker system and said second control means controlling the operational mode of said bunker system, said second control means being associated with second sensor means for sensing the presence or absence of particulate material at a preselected low level in said hopper, said second sensor means deriving a signal indicative of the presence or absence of particulate material at said low level, and third sensor means for sensing when the particulate material has reached a preselected high level in said hopper, said third sensor means deriving a signal indicative of the presence or absence of particulate material at said high level, said second control means controlling the operational mode of the bunker system in response to signals derived by said second and third sensor means and indicative of the second conditions.

7. A bunker system as claimed in claim 6 wherein said second control means is associated with fourth sensor means for sensing the presence or absence of particulate material in said bunker, said fourth sensor means deriving a signal indicative of the presence or absence of particulate material in said bunker.

8. A bunker system as claimed in claim 7 wherein said second control means is associated with fifth sensor means for sensing the presence of particulate material lodged in said hopper, said fifth sensor means deriving a signal indicative of the presence of particulate material lodged in said hopper.

9. A bunker system as claimed in claim 8 wherein said bunker comprises a component which, in use, is hauled to and fro as particulate material is fed into or discharged from the bunker, said second control means being associated with sixth sensor means for sensing the operational position of said component, said sixth sensor means deriving a signal indicative of the sensed operational position of said component.

10. A bunker system as claimed in claim 9 wherein said second control means are associated with seventh sensor means for sensing when the bunker is full, said seventh sensor means deriving a signal indicative of the bunker being full.

* * * * *